US005665038A

United States Patent [19]

Miller

[11] Patent Number: 5,665,038

[45] Date of Patent: Sep. 9, 1997

[54] FOUR IN ONE EXERCISE BENCH

[76] Inventor: Ray E. Miller, 17164 Mallard Ct., Eden Prairie, Minn. 55346

[21] Appl. No.: 762,271

[22] Filed: Dec. 9, 1996

[51] Int. Cl.[6] ..... A63B 21/078

[52] U.S. Cl. ..... 482/104; 482/142

[58] Field of Search ..... 482/94, 104, 133, 482/142, 148

[56] References Cited

U.S. PATENT DOCUMENTS

| | | | |
|---|---|---|---|
| 4,566,691 | 1/1986 | Mahnke | 482/104 |
| 4,749,190 | 6/1988 | Jennings | 482/104 |
| 5,018,727 | 5/1991 | Cornell | 482/104 |

*Primary Examiner*—Richard J. Apley
*Assistant Examiner*—John Mulcahy

[57] ABSTRACT

A new Four In One Exercise Bench for combining the four basic types of weight benches into one bench, the four basic types consisting of the bench press, decline bench, incline bench, and seated overhead press. The inventive device includes a pair of first telescoping weight supports, a back support member pivotally secured to the pair of first telescoping weight supports, a pair of second telescoping weight supports positioned opposite of the first telescoping weight supports, a head support member pivotally securing a back rest, and a spotter platform secured to the pair of first telescoping weight supports.

7 Claims, 3 Drawing Sheets

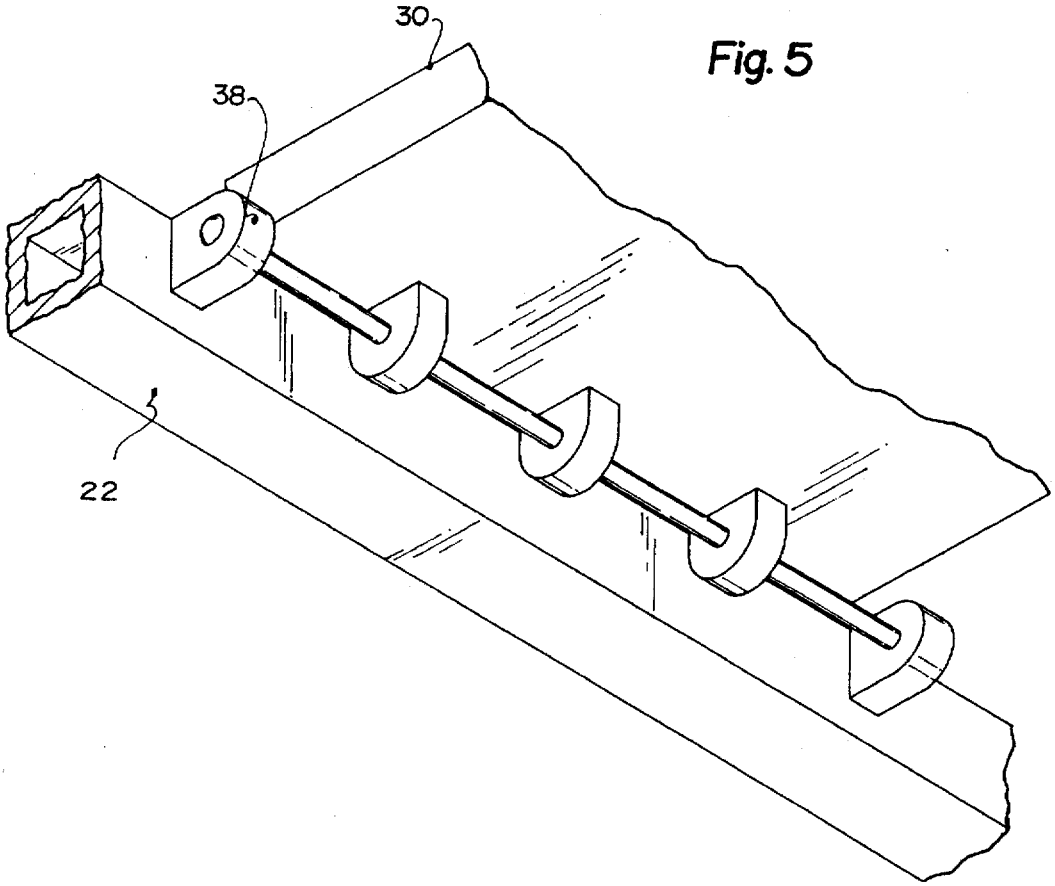
Fig. 5
Fig. 6
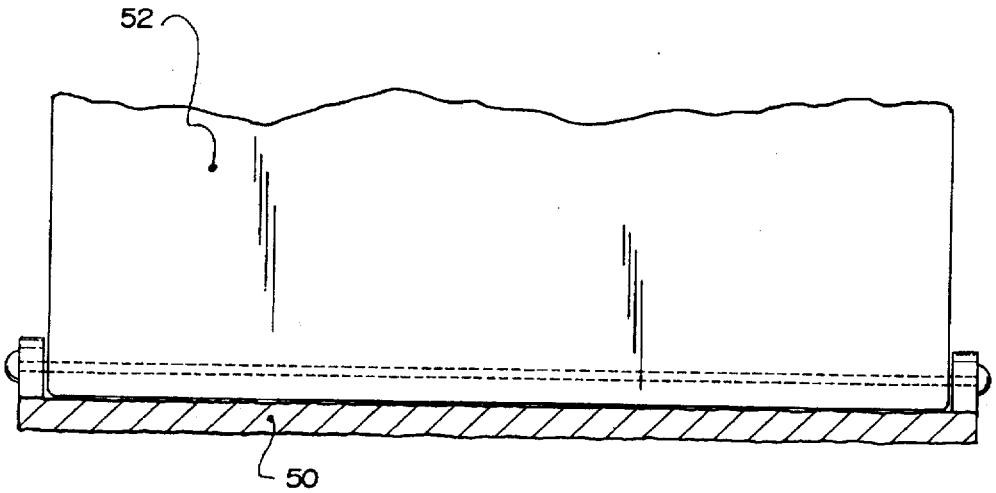

FOUR IN ONE EXERCISE BENCH

BACKGROUND OF THE INVENTION

1. Field of the Invention

The present invention relates to Weight Bench Devices and more particularly pertains to a new Four In One Exercise Bench for combining the four basic types of weight benches into one bench, the four basic types consisting of the bench press, decline bench, incline bench, and seated overhead press.

2. Description of the Prior Art

The use of Weight Bench Devices is known in the prior art. More specifically, Weight Bench Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Weight Bench Devices include U.S. Pat. No. 5,018,727; U.S. Pat. No. 4,974,839; U.S. Pat. No. 5,433,687; U.S. Pat. No. 5,350,346; U.S. Pat. No. 5,290,213 and U.S. Design Pat. No. 327,719.

While these devices fulfill their respective, particular objectives and requirements, the aforementioned patents do not disclose a new Four In One Exercise Bench. The inventive device includes a pair of first telescoping weight supports, a back support member pivotally secured to the pair of first telescoping weight supports, a pair of second telescoping weight supports positioned opposite of the first telescoping weight supports, a head support member pivotally securing a back rest, and a spotter platform secured to the pair of first telescoping weight supports.

In these respects, the Four In One Exercise Bench according to the present invention substantially departs from the conventional concepts and designs of the prior art, and in so doing provides an apparatus primarily developed for the purpose of combining the four basic types of weight benches into one bench, the four basic types consisting of the bench press, decline bench, incline bench, and seated overhead press.

SUMMARY OF THE INVENTION

In view of the foregoing disadvantages inherent in the known types of Weight Bench Devices now present in the prior art, the present invention provides a new Four In One Exercise Bench construction wherein the same can be utilized for combining the four basic types of weight benches into one bench, the four basic types consisting of the bench press, decline bench, incline bench, and seated overhead press.

The general purpose of the present invention, which will be described subsequently in greater detail, is to provide a new Four In One Exercise Bench apparatus and method which has many of the advantages of the Weight Bench Devices mentioned heretofore and many novel features that result in a new Four In One Exercise Bench which is not anticipated, rendered obvious, suggested, or even implied by any of the prior art Weight Bench Devices, either alone or in any combination thereof.

To attain this, the present invention generally comprises a pair of first telescoping weight supports, a back support member pivotally secured to the pair of first telescoping weight supports, a pair of second telescoping weight supports positioned opposite of the first telescoping weight supports, a head support member pivotally securing a back rest, and a spotter platform secured to the pair of first telescoping weight supports.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Four In One Exercise Bench apparatus and method which has many of the advantages of the Weight Bench Devices mentioned heretofore and many novel features that result in a new Four In One Exercise Bench which is not anticipated, rendered obvious, suggested, or even implied by any of the prior art Weight Bench Devices, either alone or in any combination thereof.

It is another object of the present invention to provide a new Four In One Exercise Bench which may be easily and efficiently manufactured and marketed.

It is a further object of the present invention to provide a new Four In One Exercise Bench which is of a durable and reliable construction.

An even further object of the present invention is to provide a new Four In One Exercise Bench which is susceptible of a low cost of manufacture with regard to both materials and labor, and which accordingly is then susceptible of low prices of sale to the consuming public, thereby making such Four In One Exercise Bench economically available to the buying public.

Still yet another object of the present invention is to provide a new Four In One Exercise Bench which provides in the apparatuses and methods of the prior art some of the advantages thereof, while simultaneously overcoming some of the disadvantages normally associated therewith.

Still another object of the present invention is to provide a new Four In One Exercise Bench for combining the four basic types of weight benches into one bench, the four basic types consisting of the bench press, decline bench, incline bench, and seated overhead press.

Yet another object of the present invention is to provide a new Four In One Exercise Bench which includes a pair of first telescoping weight supports, a back support member pivotally secured to the pair of first telescoping weight supports, a pair of second telescoping weight supports positioned opposite of the first telescoping weight supports, a head support member pivotally securing a back rest, and a spotter platform secured to the pair of first telescoping weight supports.

Still yet another object of the present invention is to provide a new Four In One Exercise Bench that provides the convenience of four weight benches in one bench thereby saving space.

Even still another object of the present invention is to provide a new Four In One Exercise Bench that reduces the waiting period between benches normally found at a health club.

Another object of the present invention is to provide a better workout than conventional devices in less space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 2.

FIG. 6 is a cross sectional view taken along line 6—6 of FIG. 3.

DESCRIPTION OF THE PREFERRED EMBODIMENT

Figure 1:
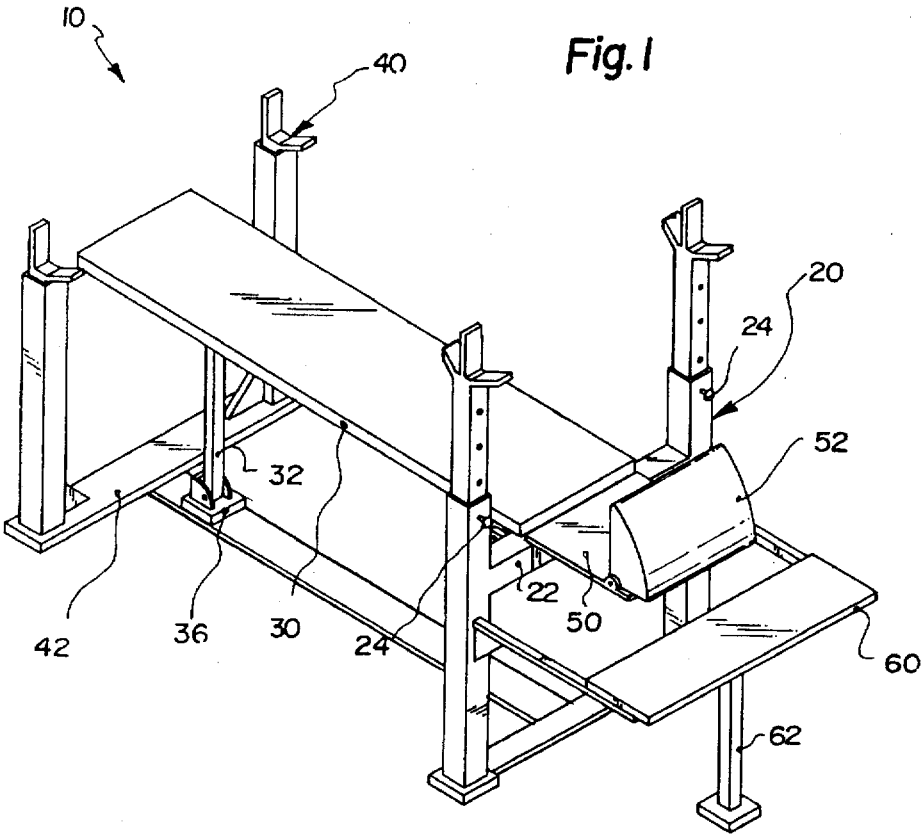
FIG. 1 is an upper side perspective view of a new Four In One Exercise Bench according to the present invention.

With reference now to the drawings, and in particular to FIG. 1 through 6 thereof, a new Four In One Exercise Bench embodying the principles and concepts of the present invention and generally designated by the reference numeral 10 will be described.

More specifically, it will be noted that the Four In One Exercise Bench 10 comprises a pair of first telescoping weight supports 20 projecting vertically, a first cross member 22 extending and connecting to the pair of first telescoping weight supports 20 centrally, a back support member 30 pivotally secured at one end to the first cross member 22 by a hinge 38, a second pair of telescoping weight supports positioned near the end of the back support member 30 opposite of the first cross member 22, a second cross member 42 extending and connecting to the pair of second telescoping weight supports 40 near the bottom ends, a head support member 50 secured horizontally to the first cross member 22 projecting away from the back support member 30, and a back rest 52 pivotally secured to the head support member 50 opposite of the first cross member 22, allowing selection between back support during a seated overhead press or a head rest during a conventional bench press motion.

Figure 2:
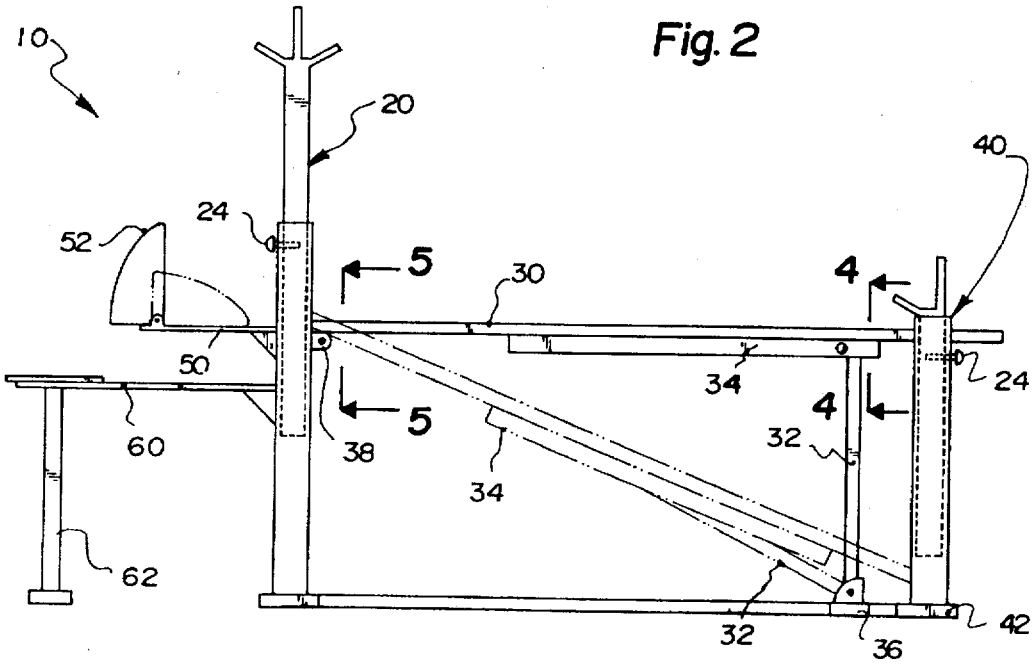
FIG. 2 is a side view of the present invention.
Figure 3:
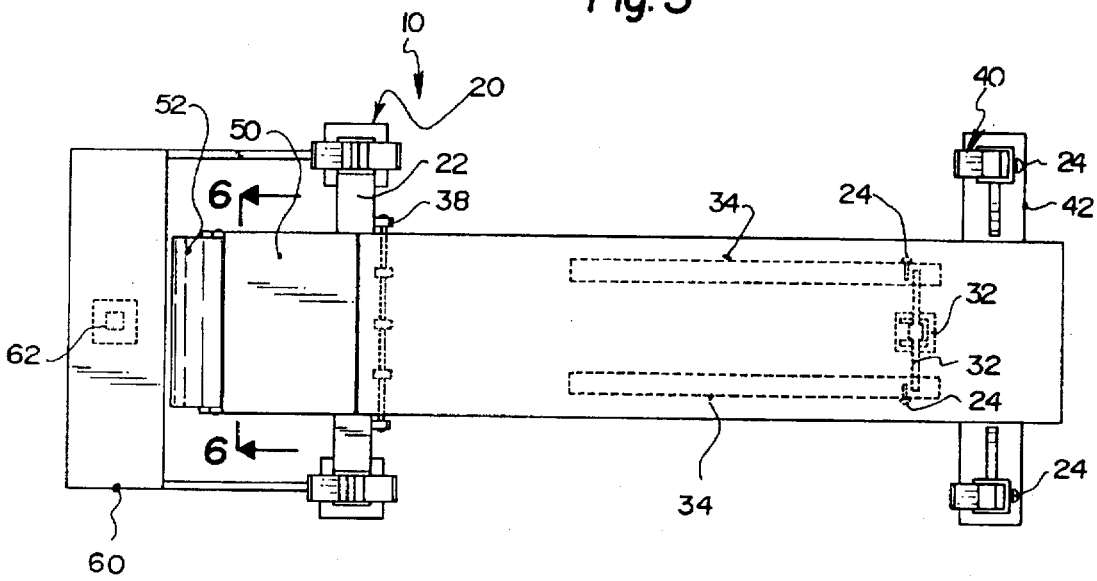
FIG. 3 is a top view of the present invention.
Figure 4:
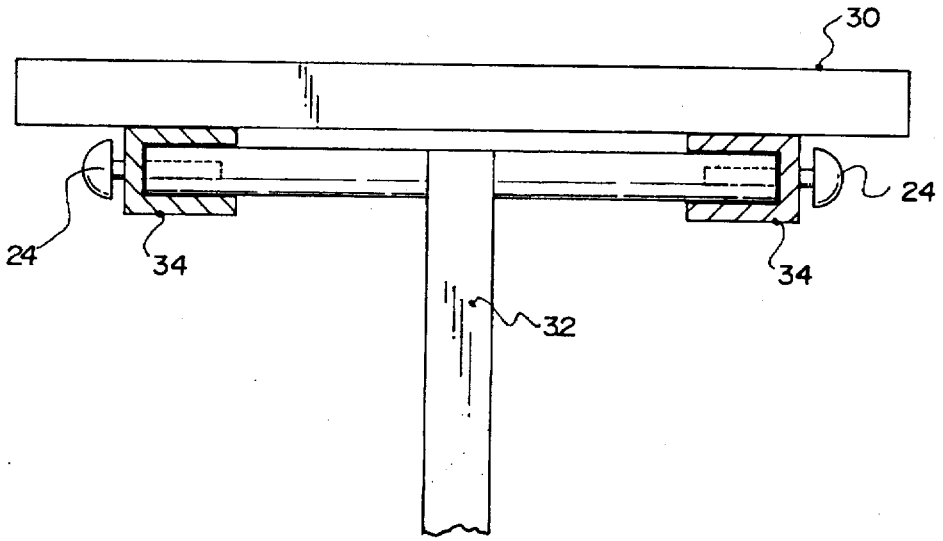
FIG. 4 is a cross sectional view taken along line 4—4 of FIG. 2.

As best illustrated in FIGS. 2 through 4, it can be shown that a leg guide 34 secures to the bottom side of the back support member 30 extending along the longitudinal axis. A T-leg 32 slidably engages the leg guide 34 thereby providing support to the end of the back support member 30 opposite of the first cross member 22 as best shown in FIG. 4 of the drawings. A pair of locking pins 24 removably project through the leg guide 34 into the T-leg 32 retaining the vertical position of the T-leg 32 during conventional bench press exercises. The pair of locking pins 24 are removable allowing the T-leg 32 to slide along the leg guide 34 allowing incline or decline bench press exercises to be performed by the user as disclosed in FIG. 2 of the drawings. A footing 36 is pivotally secured to the end of the T-leg 32 opposite of the leg guide 34, thereby providing increased stability when in the incline/decline position as shown in FIG. 2. A spotter platform 60 is secured to the pair of first telescoping weight supports 20 with a platform leg 62 projecting vertically downward from the spotter platform 60.

In use, the user positions the locking pins 24 into the T-leg 32 to do normal flat bench press exercises. When doing incline or decline exercises, the locking pins 24 are removed from the T-leg 32 and the end of the back support member 30 opposite of the first cross member 22 is descended thereby folding the T-leg 32 into the leg guide 34. When doing seated overhead press exercises, the user simply pivots the back rest 52 to be substantially vertical in relation to the head support member 50 to support the user's back.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Four In One Exercise Bench comprising:

a pair of first telescoping weight supports projecting vertically;

a first cross member extending and connecting to said pair of first telescoping weight supports centrally;

a back support member pivotally secured at one end to said first cross member by a hinge;

a second pair of telescoping weight supports positioned near the end of said back support member opposite of said first cross member;

a second cross member extending and connecting to said pair of second telescoping weight supports near the bottom ends;

a head support member secured horizontally to said first cross member projecting away from said back support member; and a back rest pivotally secured to said head support member opposite of said first cross member, allowing selection between back support during a seated overhead press or a head rest during a conventional bench press motion.

2. The Four In One Exercise Bench of claim 1, wherein:

a leg guide securing to the bottom side of said back support member extending along the longitudinal axis;

a T-leg slidably engaging said leg guide thereby providing support to the end of said back support member opposite of said first cross member; and a pair of locking pins removably projecting through said leg guide into said T-leg retaining the vertical position of said T-leg during conventional bench press exercises and removable allowing said T-leg to slide along said leg guide allowing incline or decline bench press exercises.

3. The Four In One Exercise Bench of claim 2, wherein a footing is pivotally secured to the end of said T-leg opposite of said leg guide, thereby providing increased stability when in the incline/decline position.

4. The Four In One Exercise Bench of claim 3, wherein a spotter platform is secured to said pair of first telescoping weight supports with a platform leg projecting vertically downward from said spotter platform.

5. A Four In One Exercise Bench comprising:

a pair of first telescoping weight supports projecting vertically;

a first cross member extending and connecting to said pair of first telescoping weight supports centrally;

a back support member pivotally secured at one end to said first cross member by a hinge;

a second pair of telescoping weight supports positioned near the end of said back support member opposite of said first cross member;

a second cross member extending and connecting to said pair of second telescoping weight supports near the bottom ends;

a head support member secured horizontally to said first cross member projecting away from said back support member;

a back rest pivotally secured to said head support member opposite of said first cross member, allowing selection between back support during a seated overhead press or a head rest during a conventional bench press motion;

a leg guide securing to the bottom side of said back support member extending along the longitudinal axis;

a T-leg slidably engaging said leg guide thereby providing support to the end of said back support member opposite of said first cross member; and a pair of locking pins removably projecting through said leg guide into said T-leg retaining the vertical position of said T-leg during conventional bench press exercises and removable allowing said T-leg to slide along said leg guide allowing incline or decline bench press exercises.

6. The Four In One Exercise Bench of claim 5, wherein a footing is pivotally secured to the end of said T-leg opposite of said leg guide, thereby providing increased stability when in the incline/decline position.

7. The Four In One Exercise Bench of claim 6, wherein a spotter platform is secured to said pair of first telescoping weight supports with a platform leg projecting vertically downward from said spotter platform.

* * * * *